US011394154B1

(12) United States Patent
Buchoff

(10) Patent No.: US 11,394,154 B1
(45) Date of Patent: Jul. 19, 2022

(54) PLIANT ELECTRICAL INTERFACE CONNECTOR AND ITS ASSOCIATED METHOD OF MANUFACTURE

(71) Applicant: Jeffrey G. Buchoff, Warminster, PA (US)

(72) Inventor: Leonard S. Buchoff, Warminster, PA (US)

(73) Assignee: Jeffrey G. Buchoff, Warminster, PA (US)

( * ) Notice: Subject to any disclaimer, the term of this patent is extended or adjusted under 35 U.S.C. 154(b) by 0 days.

(21) Appl. No.: 17/690,997

(22) Filed: Mar. 9, 2022

(51) Int. Cl.
*H01R 13/56* (2006.01)
*H01R 13/05* (2006.01)
*H01R 13/24* (2006.01)

(52) U.S. Cl.
CPC ..... *H01R 13/562* (2013.01); *H01R 13/05* (2013.01); *H01R 13/2435* (2013.01)

(58) Field of Classification Search
CPC .. H01R 13/562; H01R 13/05; H01R 13/2435; H01R 12/52
See application file for complete search history.

(56) References Cited

U.S. PATENT DOCUMENTS 4,998,885 A 3/1991 Beaman
5,403,194 A 4/1995 Yamazaki
5,427,535 A 6/1995 Sinclair
5,583,321 A * 12/1996 DiStefano ..... H01L 21/4857 174/250
5,773,198 A 6/1998 Swirbel et al.
5,805,424 A 9/1998 Purinton
5,967,804 A 10/1999 Yoshizawa et al.
6,019,610 A 2/2000 Glatts, III
6,079,987 A 6/2000 Matsunaga et al.
6,106,305 A 8/2000 Kozel et al.
6,174,172 B1 1/2001 Kazama
6,264,476 B1 7/2001 Li et al.
6,350,132 B1 2/2002 Glatts, III
6,425,180 B1 7/2002 Schuenemann et al.
6,832,917 B1 12/2004 Neidich
7,816,932 B2 10/2010 Cartier, Jr.
2001/0029119 A1* 10/2001 Chung ..... H01Q 1/36 439/91
2003/0146510 A1 8/2003 Chien
2003/0199181 A1 10/2003 Chou et al.
2007/0075717 A1* 4/2007 Kinghorn ..... G01R 1/07378 324/754.18
2020/0067220 A1 2/2020 Takizawa et al.

* cited by examiner

*Primary Examiner* — Travis S Chambers
(74) *Attorney, Agent, or Firm* — LaMorte & Associates P.C.

(57) ABSTRACT

A connection device for interconnecting electrical components that uses a plurality of contact layers. Each of the contact layers includes a substrate of dielectric material with a top edge, a bottom edge and side surfaces. A plurality of conductive elements extends in parallel through the dielectric material. The various contact layers are stacked. The side surfaces of the contact layers interconnect through a matrix of connective pillars. The connective pillars provide a network of open spaces between each of the contact layers. When the overall connection device is compressed, the dielectric material compresses and widens. The open areas receive the deformation and prevent the deformations from propagating lateral forces that can act to displace the conducive elements.

19 Claims, 7 Drawing Sheets

PLIANT ELECTRICAL INTERFACE CONNECTOR AND ITS ASSOCIATED METHOD OF MANUFACTURE

BACKGROUND OF THE INVENTION

1. Field of the Invention

In general, the present invention relates to electrical connectors that are used to electrically interconnect components that are pressed against opposite sides of the electrical connector. More particularly, the present invention relates to electrical connectors that are made, in part, from elastomeric or flexible materials so that the electrical connector is pliant.

2. Prior Art Description

As electronic circuitry becomes smaller and more densely populated with components, it is often difficult to interconnect separate electronic circuits using traditional soldering techniques. In many electronic assemblies, separate electronic components are placed in different areas of the assembly. Although the various electronic components will be near each other when fully assembled, these same parts are kept apart prior to assembly. In order to electrically interconnect the various electronic components prior to the final assembly, a manufacturer often uses long connection ribbons to interconnect the various separated electronic components. The long connection ribbons are then folded up into the device as the separated electronic components are assembled.

The use of such long ribbons is expensive, labor intensive, and requires space in the final assembly to hold the folded long ribbons. Furthermore, the long ribbons often become pinched as they are folded up into the final assembly, thus causing defective assemblies.

Another solution to this problem has been the use of elastomeric contact connectors. Elastomeric contact connectors are a class of connectors that contain conductive elements supported by an elastomeric body.

By placing an elastomeric connector between two electronic components, the two components can be electrically interconnected as the final product is assembled and the two electronic components are biased against the same elastomeric contact connector. Such prior art connectors are exemplified by U.S. Pat. No. 6,350,132 to Glatts. Elastomeric connectors are commercially produced by a variety of manufacturers, including Fujipoly® of Carteret, N.J.

One problem associated with elastomeric contact connectors is that of compression displacement. When the elastomeric substrate of the connector is compressed, it shortens and widens. This causes lateral forces in the body of the substrate. The lateral forces act upon the conductive material extending through the substrate. As a result, the conductive elements may move laterally as the connector is compressed. The lateral movement can cause the conductive elements to move away from established contact points, therein causing a failure in electrical conductivity between components.

In an attempt to reduce the lateral forces applied to conductors during compression, different techniques have been used with only limited success. In U.S. Pat. No. 6,106,305 to Kuzel, a technique is shown where the conductive element is designed to deform upon compression. In this manner, lateral forces will merely bend the conductor rather than move the conductor laterally. This technique works only to a limited degree because the conductor is designed to deform in a specific direction. If the lateral forces act upon the conductor from another direction, the conductor cannot bend and the conductor may be moved by the lateral forces.

Another technique used in the industry is to isolate the conductor from the elastomeric substrate. This is typically accomplished by placing the conductor into voids within the substrate. Such prior art is exemplified by U.S. Pat. No. 7,816,932 to Cartier and U.S. Pat. No. 6,079,987 to Matsunaga. The problems with such a technique are twofold. First, since the conductors pass through voids, the side of the conductors are not protected by the substrate. The exposed sides of the conductors can therefore oxidize. The oxidization changes the conductivity and impedance of the conductors, which can create operating errors in many electronic components. The second problem is that when the conductors are separated from the substrate, they lose the mechanical support of the substrate. The conductors are, therefore, much more likely to permanently deform over time. The deformation can cause loss of contact and failure of the electrical connection.

A need therefore exists for an improved pliant contact connector that keeps the conductors protected within an elastomeric substrate, yet prevents the elastomeric substrate from applying lateral displacement forces to the conductors. This need is met by the present invention as described and claimed below.

SUMMARY OF THE INVENTION

The present invention is a connection device for interconnecting electrical components. The connection device uses a plurality of contact layers that are interconnected in a unique manner. Each of the contact layers includes a substrate of dielectric material with a top edge, a bottom edge and side surfaces. A plurality of conductive elements extend in parallel through the dielectric material from the top edge to the bottom edge. Each of the conductive elements has one end exposed along the top edge and a second end exposed along the bottom edge.

The various contact layers are stacked. The side surfaces of the contact layers interconnect through a matrix of connective pillars. The connective pillars provide a network of open spaces between each of the contact layers.

The conductive elements are completely isolated by the dielectric material. However, there are open spaces in adjacent positions. When the overall connection device is compressed, the dielectric material compresses and widens. The open areas receive the deformation and prevent the deformations from propagating lateral forces that can act to displace the conducive elements from their original positions.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention pliant connector device can be embodied into many shapes and sizes, only one exemplary embodiment is illustrated. The exemplary embodiment is being shown for the purposes of explanation and description. The exemplary embodiment is selected in order to set forth one of the best modes for the invention. The illustrated embodiment, however, is merely exemplary and should not be considered a limitation when interpreting the scope of the appended claims.

Figure 1:
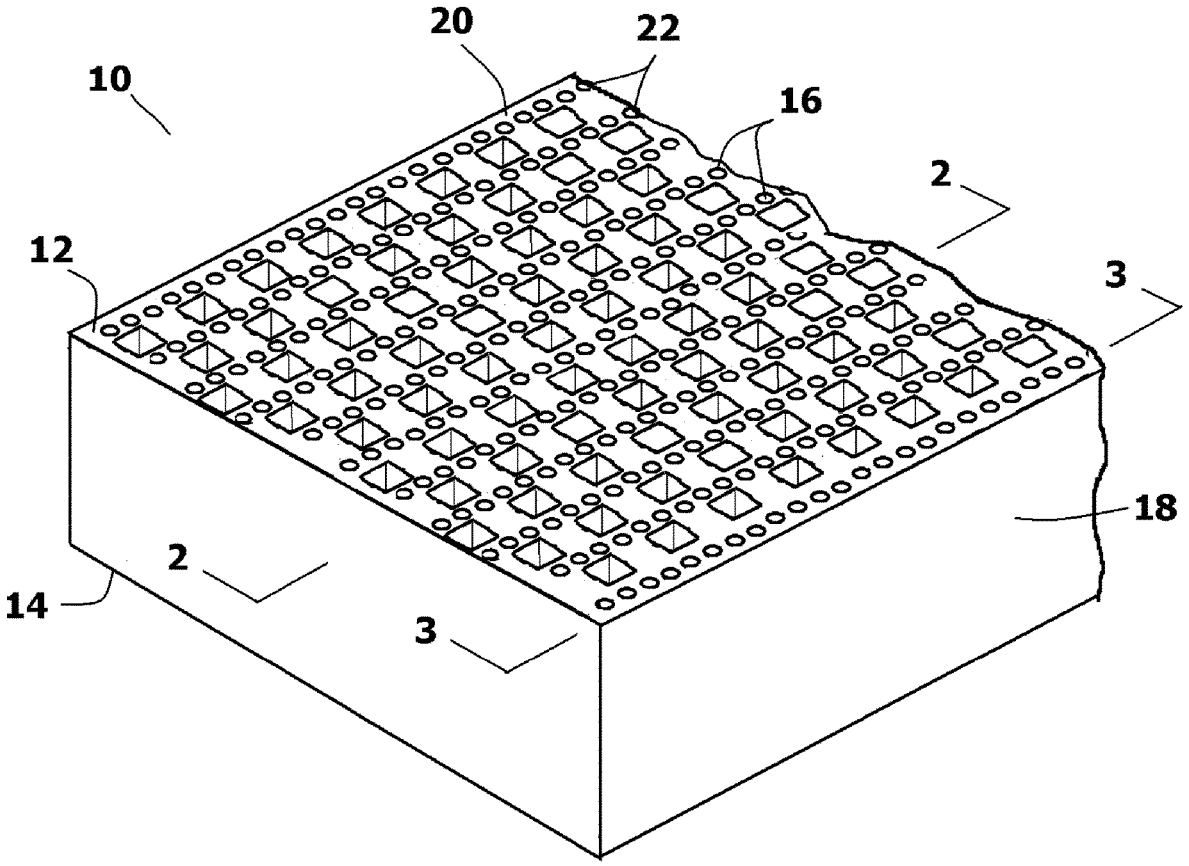
FIG. 1 is an exemplary embodiment of a pliant electrical interface connector in accordance with the present invention.
Figure 2:
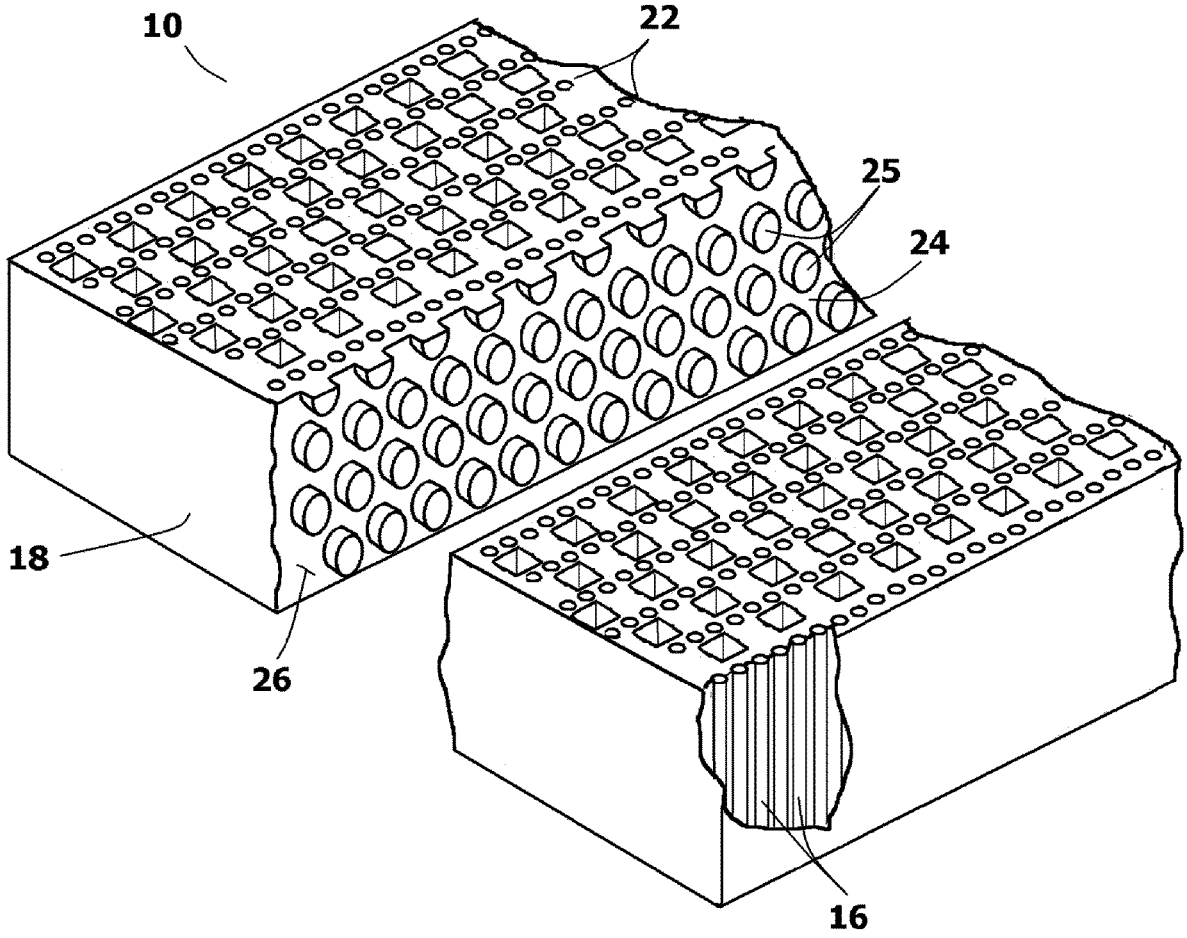
FIG. 2 is a perspective cross-sectional view of the exemplary embodiment of FIG. 1, as viewed along section line 2-2.

Referring to FIG. 1 and FIG. 2, a first embodiment of a pliant connector device 10 is shown. The pliant connector device 10 has a first top surface 12 and an opposite second bottom surface 14. A plurality of conductive elements 16 extend through a dielectric body 18 from the top surface 12 to the bottom surface 14. Each of the conductive elements 16 is isolated from the others by the dielectric body 18. However, the conductive elements 16 are exposed along the top surface 12 and the bottom surface 14. The exposed ends of the conductive elements 16 can therefore be considered as contact pads 20 on the top surface 12 and the bottom surface 14 of the pliant connector device 10. Since the contact pads 20 are exposed on the top surface 12 and on the bottom surface 14, electricity can pass through the pliant connector device 10 between the top surface 12 and the bottom surface 14.

Aside from the exposed contact pads 20 on the top surface 12 and the bottom surface 14, each of the conductive elements 16 is completely insulated by the dielectric body 18 within the pliant connector device 10. The conductive elements 16 are all parallel as they extend from the top surface 12 to the bottom surface 14. The conductive elements 16 are arranged in rows 22. The rows 22, themselves, are parallel and travel in directions that are perpendicular to the lengths of the conductive elements 16. As will be explained, the dielectric body 18 is not solid. Rather, the rows 22 are coupled by a matrix of connective pillars 25. This creates a latticework of open spaces 24 around the connective pillars 25 and between each of the rows 22.

Figure 3:
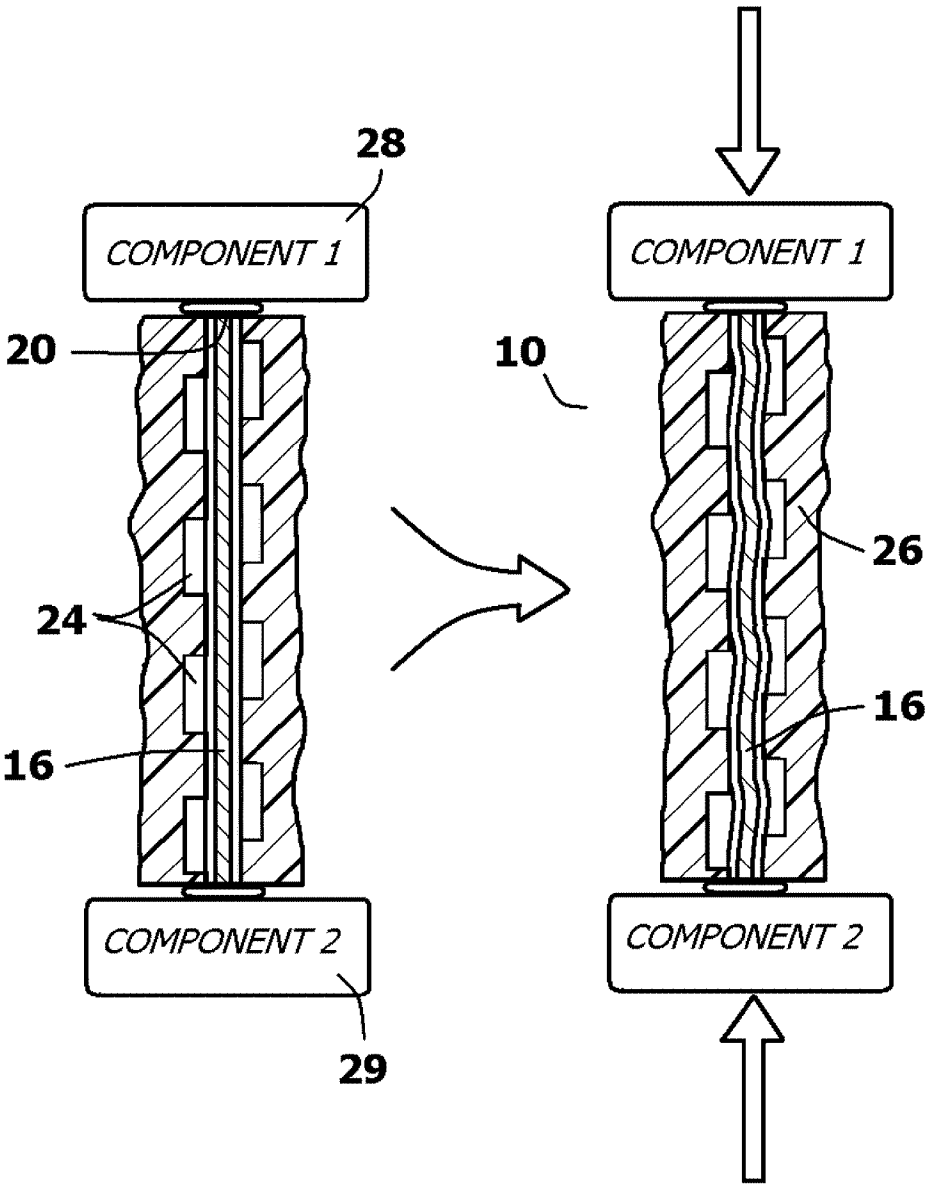
FIG. 3 is a front cross-sectional view of the exemplary embodiment of FIG. 1, as viewed along section line 3-3.

The dielectric body 18 is made of an elastomeric material 26, such as silicone, thermoplastic rubber (TPR) or another synthetic dielectric rubber. Due to the durometer of the elastomeric material 26, the elastomeric material 26 is pliant and compresses when squeezed. Referring to FIG. 3 in conjunction with FIG. 2, it will be understood that open spaces 24 exist between the rows 22 of conductive elements 16. Accordingly, the open spaces 24 are adjacent to the conductive elements 16 within the pliant connector device 10. The pliant connector device 10 is set between two electrical components 28, 29. The electrical components 28, 29 touch the contact pads 20 that are the exposed ends of the conductive elements 16. When compressed, the elastomeric material 26 within the pliant connector device 10 reduces in thickness and expands in width. The open spaces 24 within the pliant connector device 10 provide room for this compressional widening. In this manner, the elastomeric material 26 can widen without pressing laterally against the conductive elements 16. Accordingly, compression of the pliant connector device 10 does not create internal lateral forces on the conductive elements 16 that can laterally alter the position of the conductive elements 16. The conductive elements 16, therefore, remain in the same position. As a consequence, the contact pads 20 that are the exposed ends of the conductive elements 16 also remain in the same position. This produces a stable electrical contact between the electrical components 28, 29 and the contact pads 20.

Figure 4:
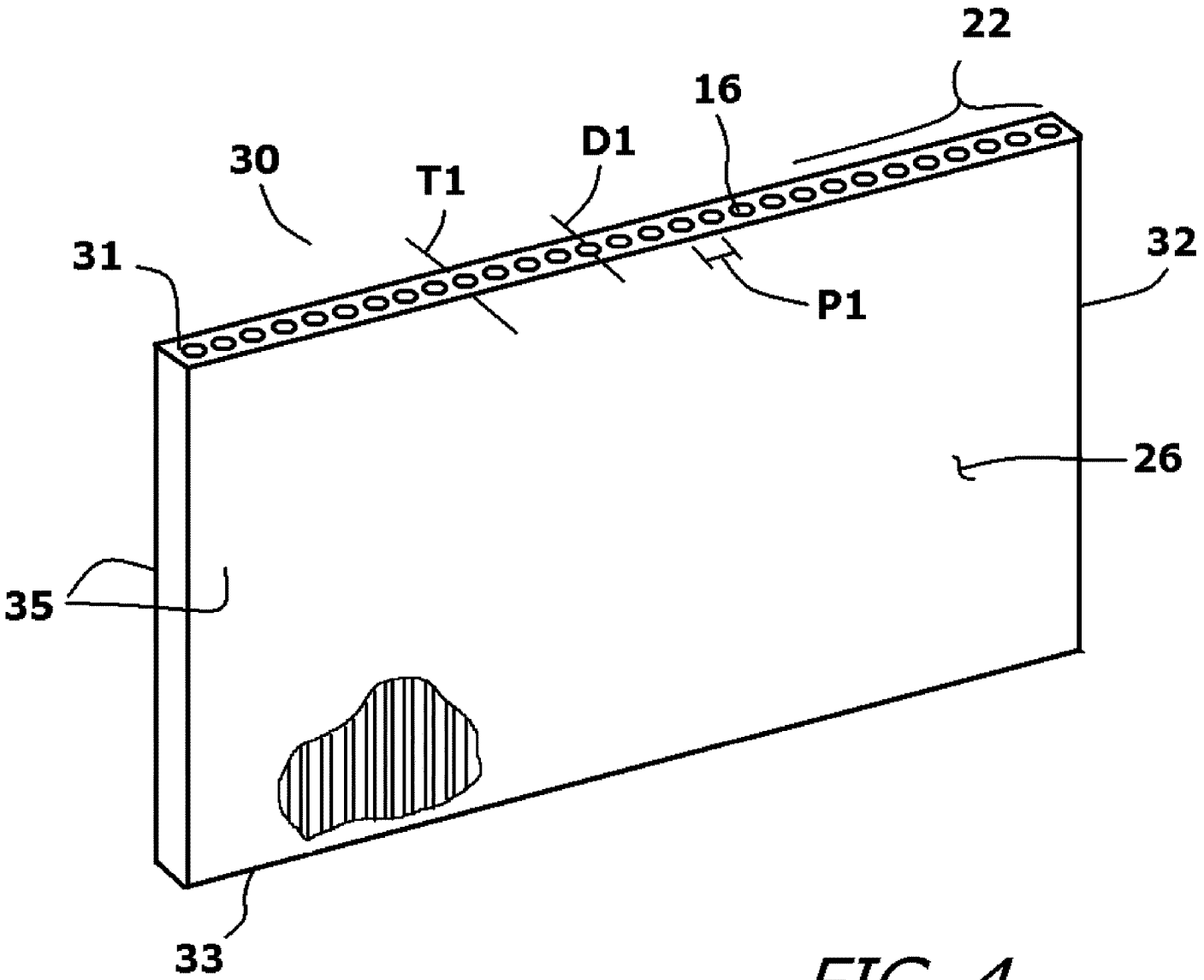
FIG. 4 shows a single contact layer used within the exemplary embodiment.

Referring to FIG. 4 in conjunction with FIG. 1 and FIG. 2, it will be understood that the pliant connector device 10 is made from stacked layers. The rows 22 of conductive elements 16 are set into a ribbon 32 of the elastomeric material 26 to produce a contact layer 30. A single contact layer 30 is shown in FIG. 4. Each contact layer 30 has a top edge 31, a bottom edge 33, and side surfaces 35 that run between the top edge 31 and the bottom edge 33. The conductive elements 16 run in parallel between the top edge 31 and the bottom edge 33 within the confines of the two side surfaces 35.

The positioning of the conductive elements 16 into the ribbon 32 is accomplished by setting parallel lengths of conductive elements 16 into an adhesive layer of uncured elastomeric material 26. The elastomeric material 26 is then cured to complete the contact layer 30. The conductive elements 16 can be segments of wire, such as copper wire, having a given gauge diameter D1. However, any conductive material can be used. The ribbon 32 of elastomeric material 26 preferably has a thickness T1 that is approximately twice the thickness of the gauge diameter D1 of a conductive element 16. The conductive elements 16 are also preferably spaced apart at a pitch distance P1, from center to center, that is twice the thickness of the gauge diameter D1. Accordingly, if the conductive element 16 is a wire with a gauge diameter of 0.002 inches, the ribbon 32 of elastomeric material 26 would have a thickness of 0.004 inches and the center-to-center pitch of the conductive elements 16 would be 0.004 inches.

Figure 5:
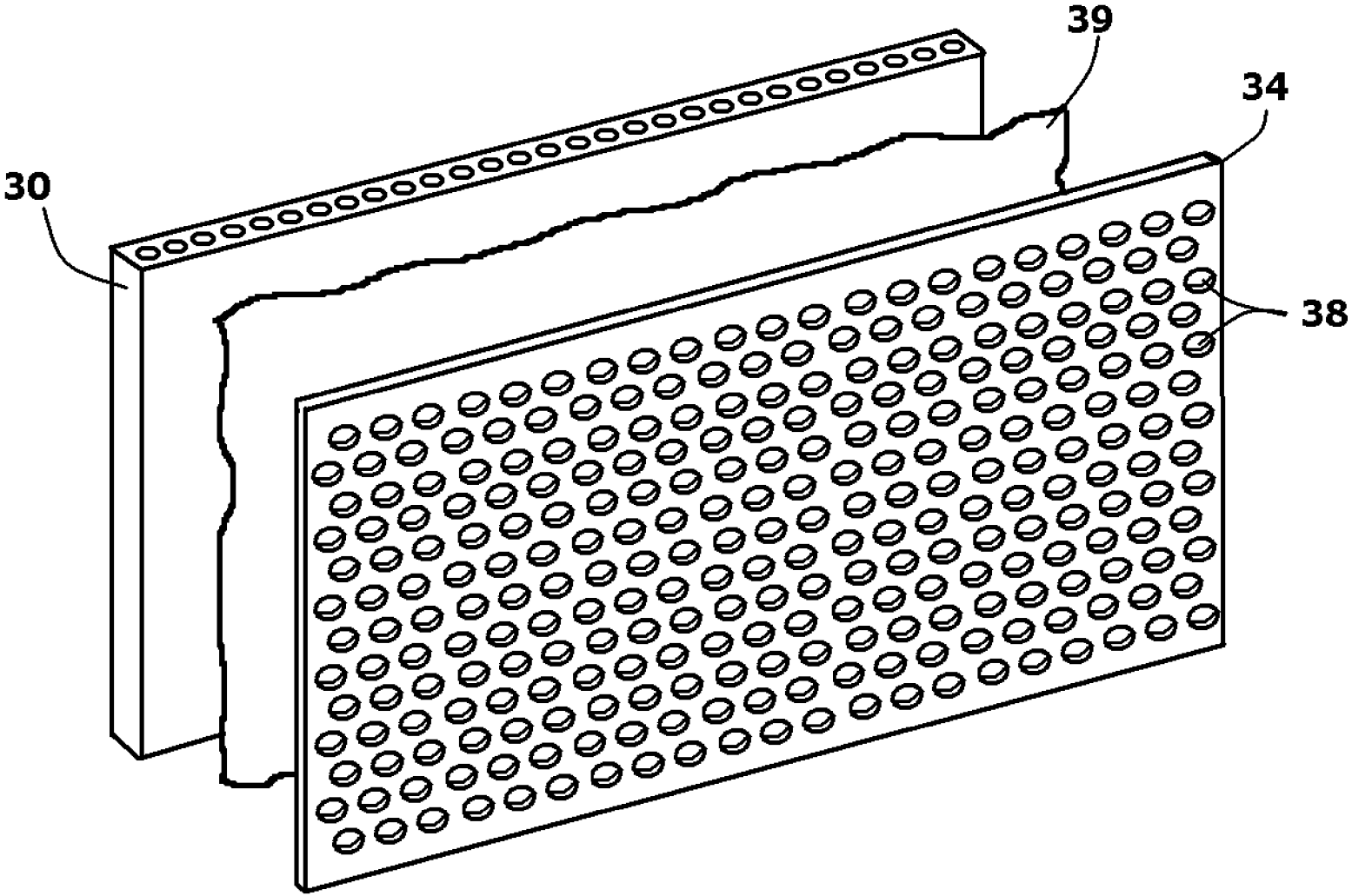
FIG. 5 shows the contact layer of FIG. 4 in conjunction with a perforated layer and an adhesive layer.

Referring to FIG. 5 in conjunction with FIG. 4, it can be seen that during manufacture, the contact layer 30 is stacked against a perforated layer 34. The perforated layer 34 is made from a sheet of polyvinyl alcohol 36 or another polymer that is highly soluble. The sheet of polyvinyl alcohol 36 is perforated with a matrix of holes 38. The holes 38 can be formed in the sheet of polyvinyl alcohol 36 using masked dissolution, laser cutting, stamping or etching. Once the matrix of holes 38 is formed, the sheet of polyvinyl alcohol 36 is cut to size, therein forming the perforated layer 34. The sheet of polyvinyl alcohol 36 is then adhered to the contact layer 30 using a coating layer of uncured elastomeric material 39. The coating layer of uncured elastomeric material 39 is sufficient in volume to fill all of the holes 38.

Figure 6:
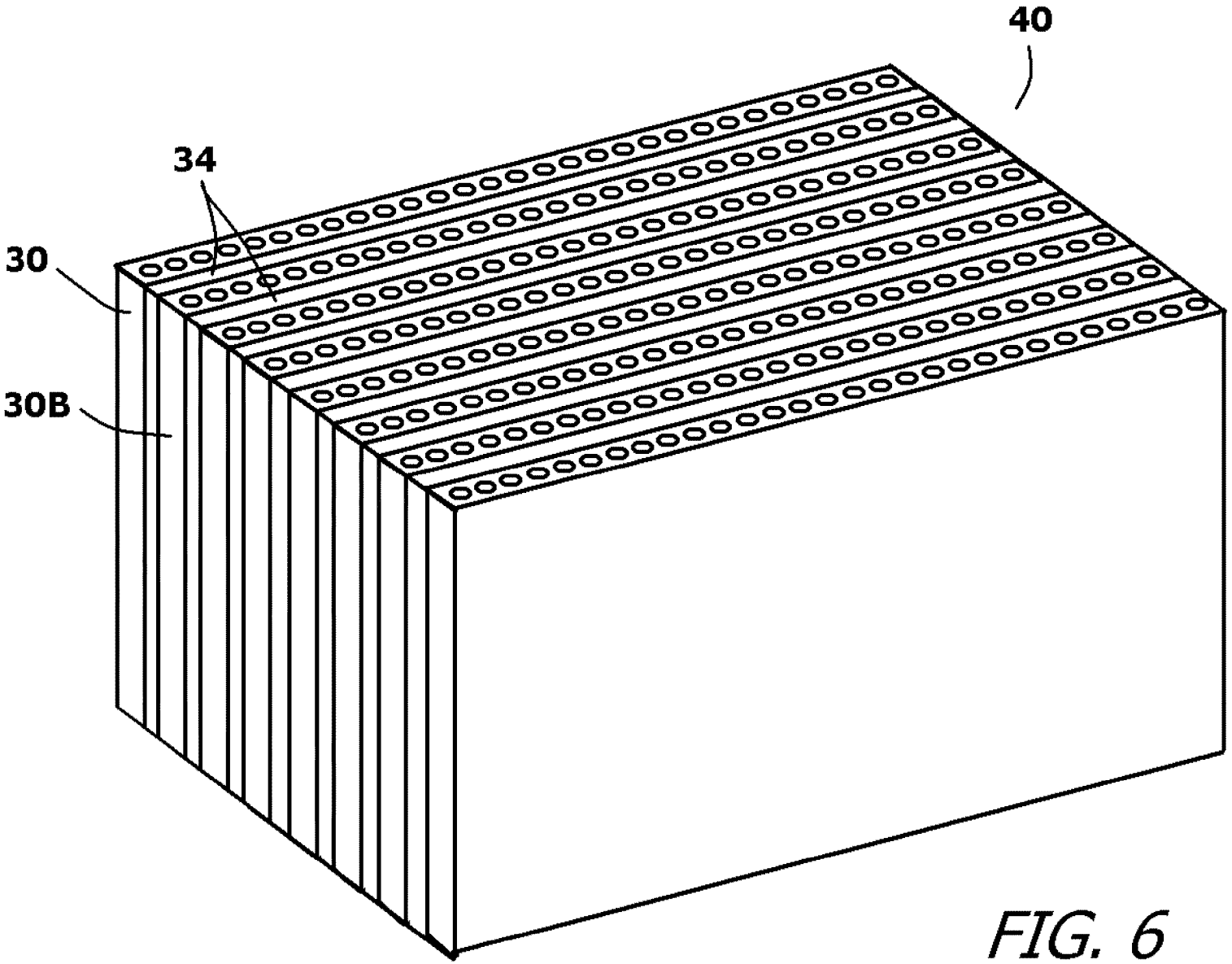
FIG. 6 shows the layers of FIG. 5 repeated to show a stack.

Referring to FIG. 6 in conjunction with FIG. 4 and FIG. 5, it will be understood that the process is repeated with a second contact layer 30B being adhered to the perforated layer 34 with more uncured elastomeric material 39. The process is repeated until a stack 40 is produced where multiple perforated layers 34 are interposed between multiple contact layers 30. The stack 40 can have any length and width and any thickness. Once a stack 40 of sufficient size is created, a finishing process is applied.

Figure 7:
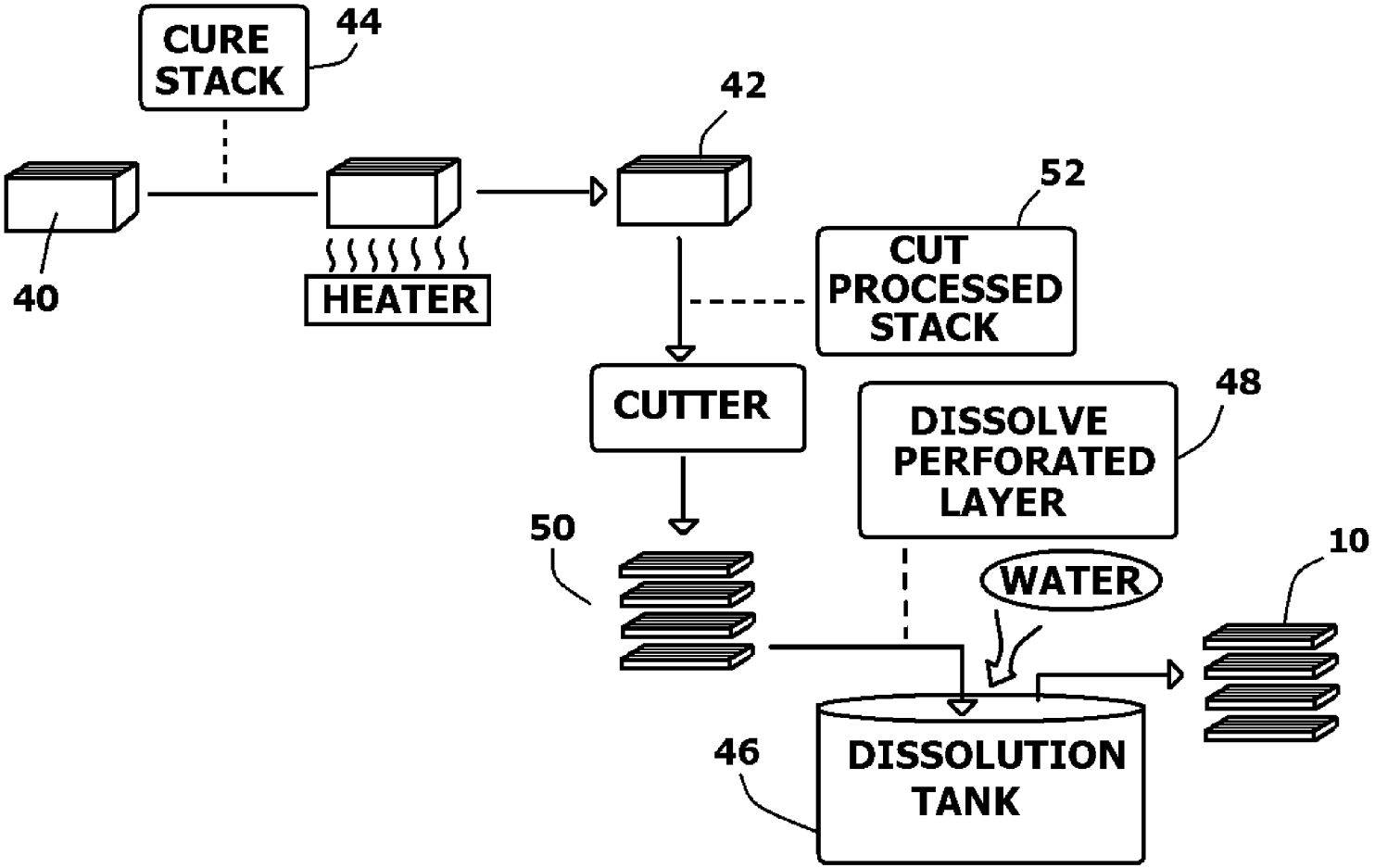
FIG. 7 shows a finishing process applied to the stack of FIG. 6.

Referring to FIG. 7 in conjunction with FIG. 6, FIG. 5 and FIG. 2, the finishing process is explained. The stack 40 is heated until the adhesive layers of uncured elastomeric material 39 becomes cured. This permanently bonds all contact layers 30 and all perforated layers 34 together into a cured stack 42. See Block 44. The cured stack 42 contains the perforated layers 34 of polyvinyl alcohol, which are highly soluble. As is indicated by Block 52, the processed stack 50 is cut to size, therein producing cut blanks 50. The cut blanks 50 are then placed in a dissolution tank 46. In the dissolution tank, the perforated layers 34 within the cut blanks 50 are dissolved away. See Block 48. If the perforated layers 35 are water soluble, distilled water is used to dissolve the perforated layers 34. If the perforated layers 35 are made using a material that dissolves in another solvent, then that solvent can be used in place of water, provided the solvent does not affect the remaining elastomeric material. After the perforated layers 34 are dissolved away the contact layers 30 are interconnected by the connective pillars 25. The connective pillars 25 are created by the elastomeric material 39 that is used as adhesive and extends through the holes 38 in the perforated layers 34.

Returning to FIG. 1, FIG. 5, and FIG. 7, it will now be understood that the density of the conductive elements 16 on the pliant connector device 10 is determined by the gauge diameter D1 of the conductive elements 16, the pitch spacing P1, the thickness of each contact layer 30, and the number of contact layers 30 assembled into a processed stack 50. The length and thickness of the pliant connector device 10 is determined by how the processed stack 50 is cut.

It will be understood that the embodiment of the present invention that is illustrated and described is merely exemplary and that a person skilled in the art can make many variations to that embodiment. For instance, the size and shape of the pliant connector device can be varied. All such embodiments are intended to be included within the scope of the present invention as defined by the claims.

What is claimed is:

1. A connection device for interconnecting electrical components, comprising:

a plurality of contact layers, wherein each of said contact layers includes dielectric material with a top edge, a bottom edge and side surfaces, wherein conductive elements extend in parallel through said dielectric material from said top edge to said bottom edge, wherein each of said conductive elements has one end exposed along said top edge and a second end exposed along said bottom edge;

wherein said plurality of contact layers are stacked and said side surfaces of said contact layers interconnect through a matrix of connective pillars that provide a network of open spaces around said connective pillars and between each of said contact layers.

2. The device according to claim 1, wherein said dielectric material is an elastomeric polymer.

3. The device according to claim 1, wherein said conductive elements are segments of metal wire.

4. The device according to claim 3, wherein each of said contact layers has a thickness between said side surfaces, and each of said segments of metal wire has a gauge diameter, wherein said gauge diameter is half of said thickness.

5. The device according to claim 3, wherein each of said segments of metal wire has a gauge diameter, and said segments of metal wire are spaced at a center-to-center spacing of twice said gauge diameter in each of said contact layers.

6. A connection device for interconnecting electrical components, comprising:

a dielectric body having a top surface and an opposite bottom surface;

a plurality of conductive elements that extend through said dielectric body in parallel from said top surface to said bottom surface, wherein said plurality of conductive elements are arranged in rows within said dielectric body, and wherein open spaces exist between said rows within said dielectric body that are traversed by a matrix of connective pillars.

7. The device according to claim 6, wherein said dielectric material is an elastomeric polymer.

8. The device according to claim 6, wherein said rows of said plurality of conductive elements are prefabricated as cured layers, wherein adhesive layers join said cured layers together.

9. The device according to claim 8, wherein said matrix of connective pillars is formed in said adhesive layers.

10. The device according to claim 8, wherein said conductive elements are segments of metal wire.

11. The device according to claim 10, wherein each of said contact layers has a thickness and each of said segments of metal wire has a gauge diameter, wherein said gauge diameter is half of said thickness.

12. The device according to claim 10, wherein each of said segments of metal wire has a gauge diameter, and said segments of metal wire are spaced at a center-to-center spacing of twice said gauge diameter in each of said cured layers.

13. A method of fabricating a connecting device, comprising the steps of:

providing a plurality of contact layers, wherein each of said contact layers includes dielectric material with a top edge, a bottom edge, and side surfaces, wherein conductive elements extend in parallel through said dielectric material from said top edge to said bottom edge, and wherein each of said conductive elements has one end exposed along said top edge and a second end exposed along said bottom edge;

providing perforated sheets of soluble material;

adhering said perforated sheets of soluble material between said plurality of contact layers in an alternating pattern to form a stack;

curing said stack; and dissolving said perforated sheets of soluble material from said stack with a solvent.

14. The method according to claim 13, wherein said dielectric material is a curable elastomeric polymer.

15. The method according to claim 13, wherein said perforated sheets of soluble material are adhered to said side surfaces of said contact layer with the same said curable elastomeric polymer as is used for said dielectric material.

16. The method according to claim 13, wherein providing the plurality of contact layers includes setting parallel lengths of said conductive elements into uncured elastomeric material and curing said elastomeric material.

17. The method according to claim 13, further including the step of cutting said connecting device from said stack.

18. The method according to claim 13, wherein said perforated sheets of soluble material are water soluble and said solvent is water.

19. The method according to claim 18, wherein said perforated sheets of soluble material are polyvinyl alcohol.

* * * * *